United States Patent [19]

David

[11] Patent Number: 4,790,775

[45] Date of Patent: Dec. 13, 1988

[54] TRANSITION CONNECTOR

[75] Inventor: James J. David, Etters, Pa.

[73] Assignee: E. I. Du Pont de Nemours and Company, Wilmington, Del.

[21] Appl. No.: 154,092

[22] Filed: Feb. 9, 1988

[51] Int. Cl.[4] ..... H01R 17/04

[52] U.S. Cl. ..... 439/579

[58] Field of Search ..... 439/578–585

[56] References Cited

U.S. PATENT DOCUMENTS

| | | | |
|---|---|---|---|
| 3,149,893 | 9/1964 | Dupre | 339/14 |
| 3,745,509 | 7/1973 | Woodward et al. | 339/14 |
| 4,181,384 | 1/1980 | Dola | 339/14 |
| 4,412,715 | 11/1983 | Bogese, II | 339/97 |
| 4,471,158 | 9/1983 | Roberts | 174/52 |
| 4,491,381 | 1/1985 | Harnsher, Jr. et al. | 339/107 |
| 4,576,662 | 3/1986 | Lemke | 156/52 |
| 4,582,844 | 4/1986 | Koser et al. | 339/17 |
| 4,612,691 | 9/1986 | Aikens | 29/33 |

OTHER PUBLICATIONS

Serpent Connectors–Special Connectors, pp. 400–407.

*Primary Examiner*—Joseph H. McGlynn

[57] ABSTRACT

A connector for a multi-conductor cable provides for connecting conductors arranged in different conductive patterns by means of a terminal array that is arranged in predetermined patterns by blanking out terminals from strips to produce multiple styles of terminals that provide for mechanical and welding terminations of the conductor within the terminal array.

4 Claims, 5 Drawing Sheets

TRANSITION CONNECTOR

BACKGROUND OF THE INVENTION

This invention relates to a transition connector and more particularly it relates to a transition connector for connecting a plurality of coaxial cables arranged in different conductive patterns for electrical interfaces between components of digital computers.

Presently, cable assemblies of a plurality of coaxial conductors are used as the main interconnection for mainframe computers of several manufacturers. The cables are double ended assemblies with terminated connector assemblies on both ends having terminals for each signal and ground wire of each coaxial conductor. The raw cable itself consists of a plurality of individual coaxial conductors ordered in a bundled array to assure the outer diameter of the cable is kept as small as possible. An additional outer shield around the bundle of individual coaxial conductors may also be present for cables with high signal speed applications. Electrical contact is made via crimp connections with serpent terminals. The "signal" contact is made to the signal wire, while the "ground" contact is made to the drain wire of the outer shield on the individual conductors. The "crimp" contact is the only termination made to the wire or shield drain wire. There are no redundant terminations. There have been quality problems with a crimp type of connection. The electrical contact is achieved via the induced pressure between terminal and wire. The crimp type connection is known to fluctuate causing inconsistent and intermittent connections. An application machine applies the terminals. This machine requires the operator to individually handle each conductor for proper termination. This termination technique is highly labor intensive. Permanent electrical isolation between each ground and signal termination is achieved via shrink tubing. Each signal wire and each drain wire have shrink tubing applied. This operation is also labor intensive and costly. The terminals are then hand-stuffed and latched into a mating block. There are predetermined patterns into which these terminals must be assembled. Assurance that the terminals have been properly inserted into the mating block is achieved via electrical testing. Improper assembly requires disassembly and reinserting of the terminals. Normally, the ground and signal terminations (via serpent terminals) of an individual conductor are located adjacent to one another in the mating block. However, the predetermined patterns, in several instances, calls for the signal and ground terminations to be located several positions apart, or "jumped" to different locations. The "jumping" requirement is currently achieved by exposing a longer-than-normal drain wire on the conductor that requires jumping capability. This calls for different preparation techniques for these "jumper" conductors. It also adds cost to the construction of the cable.

The crimping operation, the proper application of shrink tubing to each termination, the hand-inserting of each individual terminal and the requirement for "jumper" terminations are all variable operations and subject to human error. Each variable has a direct effect on the cable assembly's reliability as well as the yields in the construction of the cable assembly.

SUMMARY OF THE INVENTION

A new termination technique addresses and eliminates the variability associated with each of the abovenoted operations. The intent of this new technique is to reduce the manufacturing cost while increasing the manufacturing yield in the assembly process. An increase in the reliability of each termination, be it a signal or ground termination, is also a goal of this technique.

This invention utilizes the ordered array concept, disclosed by Lemke in U.S. Pat. No. 4,576,662 as well as the wire management concept disclosed by Aikens in U.S. Pat. No. 4,612,691. Each patent is incorporated herein by reference.

Once the ends of each of the conductors are prepared for termination, either by hand-stripping or by the concept introduced in the Aiken patent, in which finite lengths of the signal wire, dielectric tube and braided shield of the conductor are exposed, the terminals may be applied to a terminal block. The terminal block is a molded plastic block with molded-in channels, cavities, and features that allow proper mating of the conductors with pre-cut terminals (that have been latched into the terminal block). The pre-cut terminals are inserted into the block in the necessary predetermined patterns mentioned earlier. The proper ground/signal arrangement, including the "jumping" requirement, is achieved by selectively "blanking-out" terminals from two different terminal strips. The "blanking-out" process produces six different styles of terminals--right and left ground, right and left signal, modified ground and jumper terminal.

The conductors are then seated into the terminal blocks. The signal wire is nested between a pair of plastic posts, in order to assure electrical isolation from adjacent terminals, and is further nested between two upturned ends with slots resembling a two-prong fork (which are an integral part of each signal terminal) to assure the wire is properly located for laser welding as well as provide a redundant mechanical contact (as a safeguard against improper or insufficient laser welding).

Similarly, the braided shield is nested between a fork which guides the braid as well as provides an additional mechanical termination.

DETAILED DESCRIPTION OF THE PREFERRED EMBODIMENT

Figure 1:
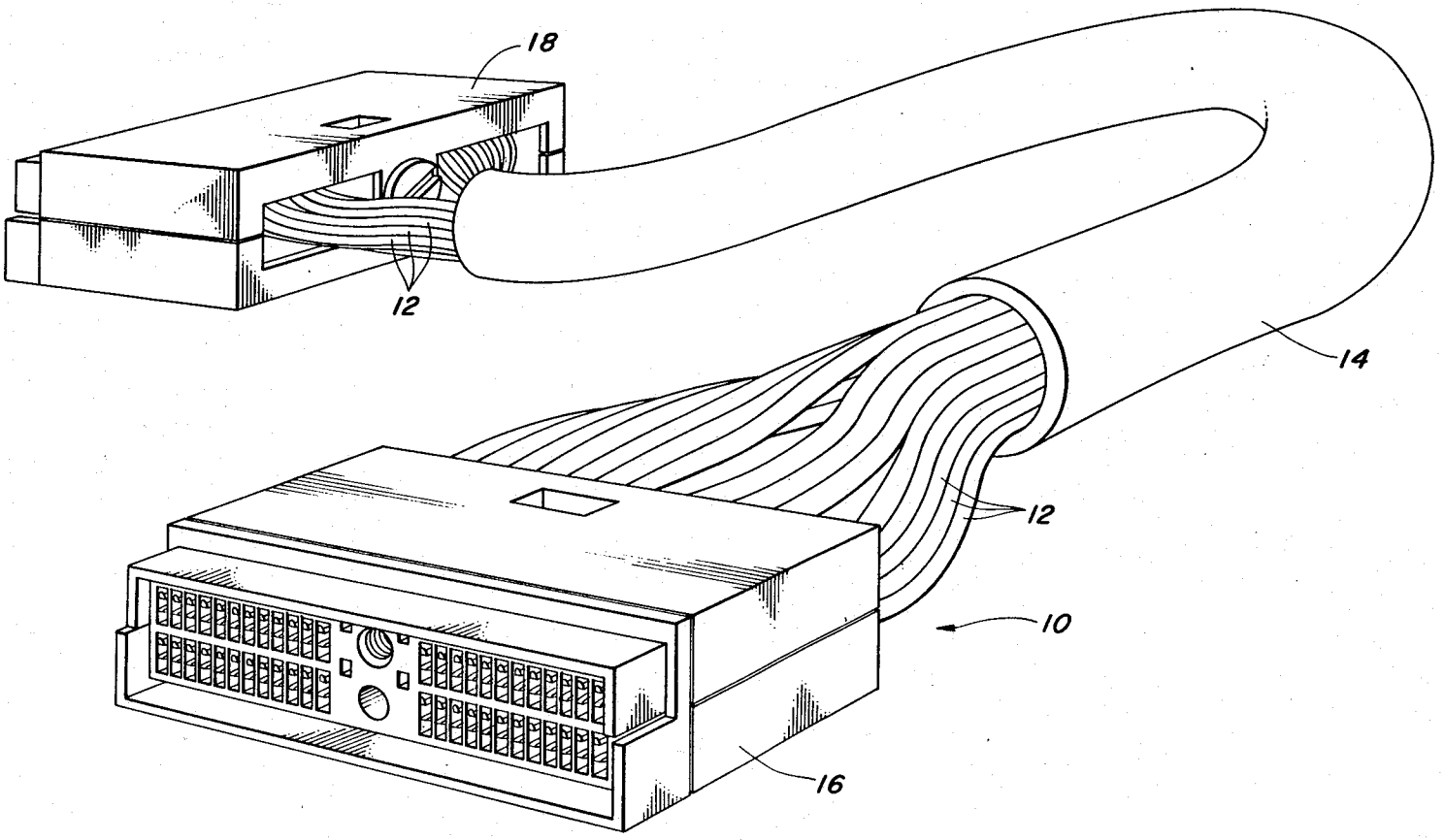
FIG. 1 is a perspective view of the cable assembly.

The embodiment chosen for purposes of illustration as shown in FIG. 1 includes, as part of the cable assembly 10, a plurality of coaxial conductors 12 surrounded by an outer shield 14 terminated in connectors 16 and 18 at each end of the cable assembly.

Figure 2A:
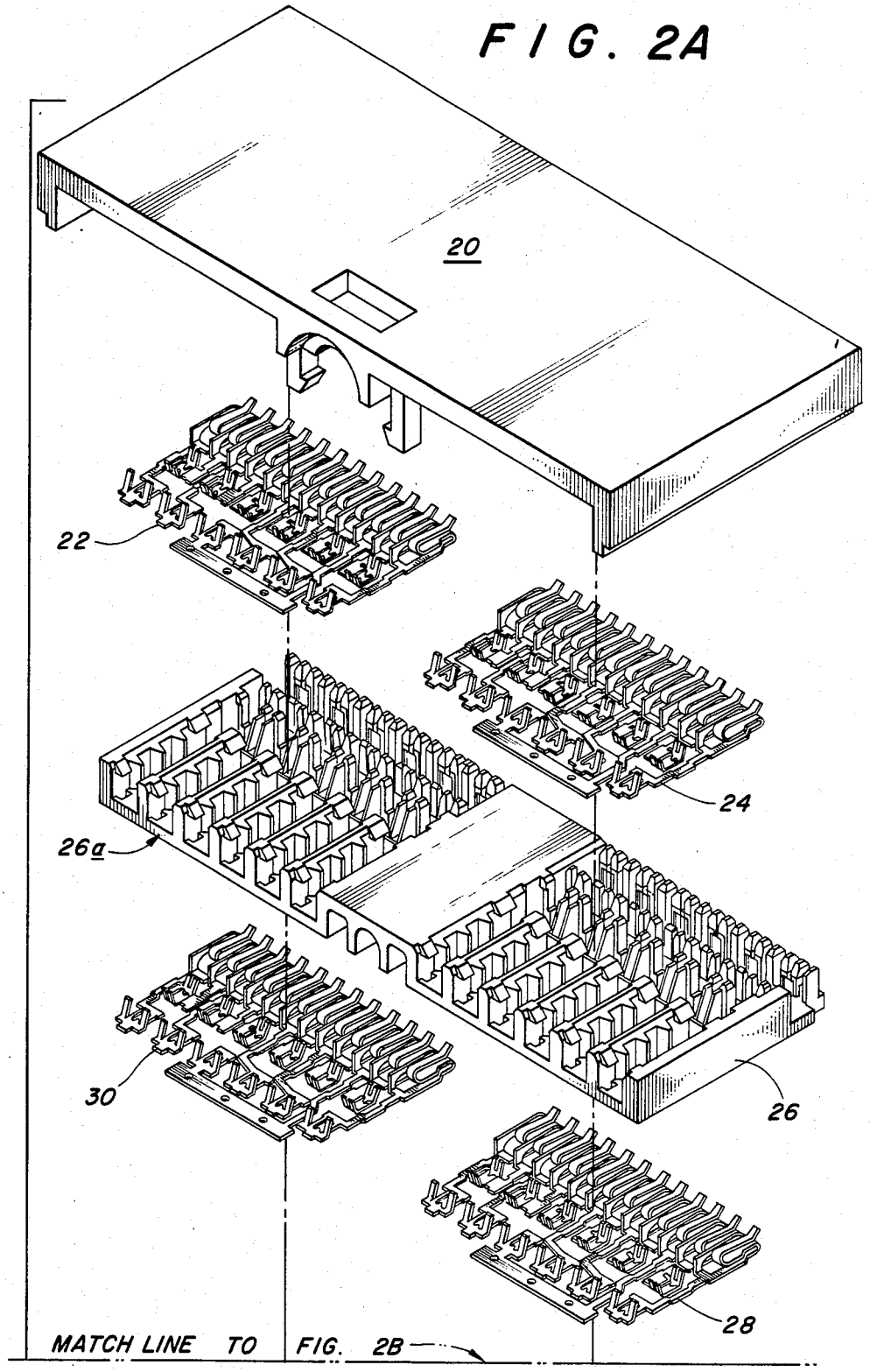
FIGS. 2A and 2B are an exploded view of one end connector of FIG. 1.
Figure 2B:
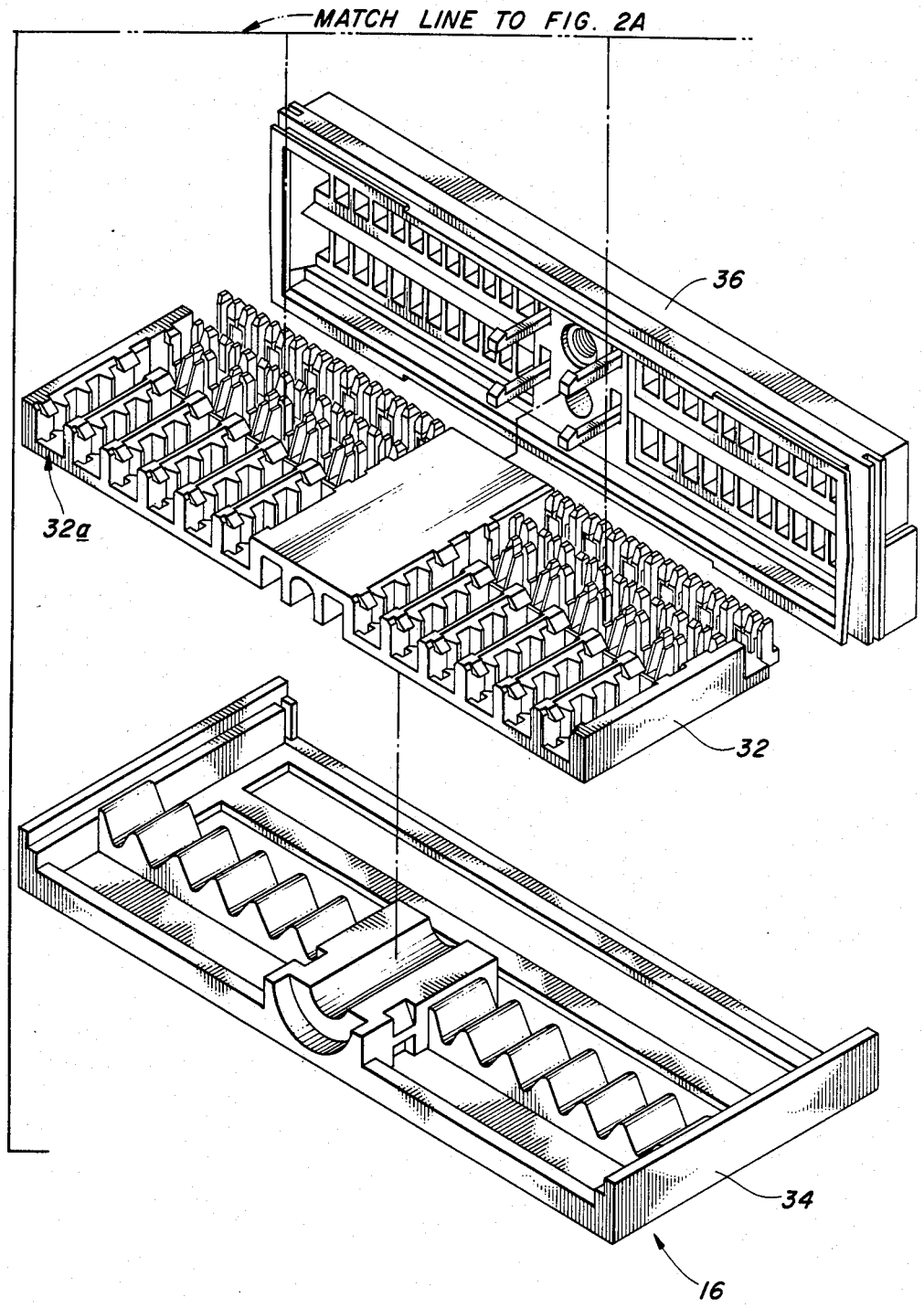

Referring now to FIG. 2, connector 16 is shown in an exploded view to include a top cover 20, upper terminal arrays 22, 24 an upper terminal block 26, lower terminal arrays 28, 30, lower terminal block 32, bottom cover 34 and front block 36. The terminals in arrays 22, 24, 28 and 30 are, because of their serpentine contact appearance, commonly referred to as serpent terminals. Precut and inserted into the channels 26*a*, 32*a* of the molded plastic terminal blocks 26, 32 in prearranged patterns. The coaxial conductors are joined to the terminals and welded in the terminal blocks using laser welding techniques and then the terminal blocks are assembled with the front block 36 along with the top and bottom covers 20, 34 to form the completed connector 16.

As mentioned above the terminal arrays are precut and formed. FIGS. 3-6 illustrate this in greater detail. More particularly, the terminal array 24 (FIG. 3) includes signal wire tabs 40, 42, 44, 46, 48 and 50 and ground wire tabs 41, 43, 45, 47, 49 and 51. These tabs are joined to their respective serpentine terminals (differentiated from the tab by the letter a); e.g., 40*a*, 42*a*, 41*a*, 43*a*, etc., by conductive paths 41*b*–51*b*. The different styles mentioned above as right left ground, right, left signal, modified ground and jumper terminal are all shown in FIG. 3. For example, tab 51 and ground serpentine terminal 51*a* is considered a left hand ground because the center line of tab 51 is to the left side of the center of the serpentine terminal 51*a*. For the same reason because of the relation of centers of signal tab 50 and signal terminal 50*a*, this is called a right hand signal. Tab 45 and its related terminal 45*a* is called a modified ground while tab 47 and its related ground terminal 47*a* is called a jumper terminal because the distance between center lines encompasses several terminals.

Figure 4:
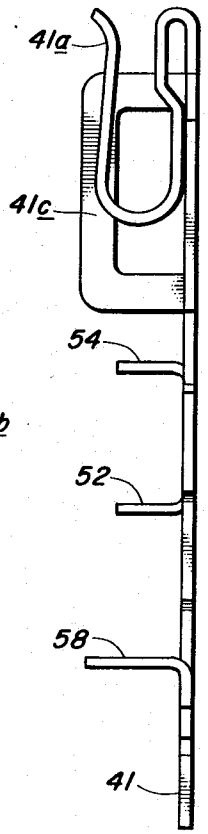
FIG. 4 is a side elevation view of FIG. 3.
Figure 3:
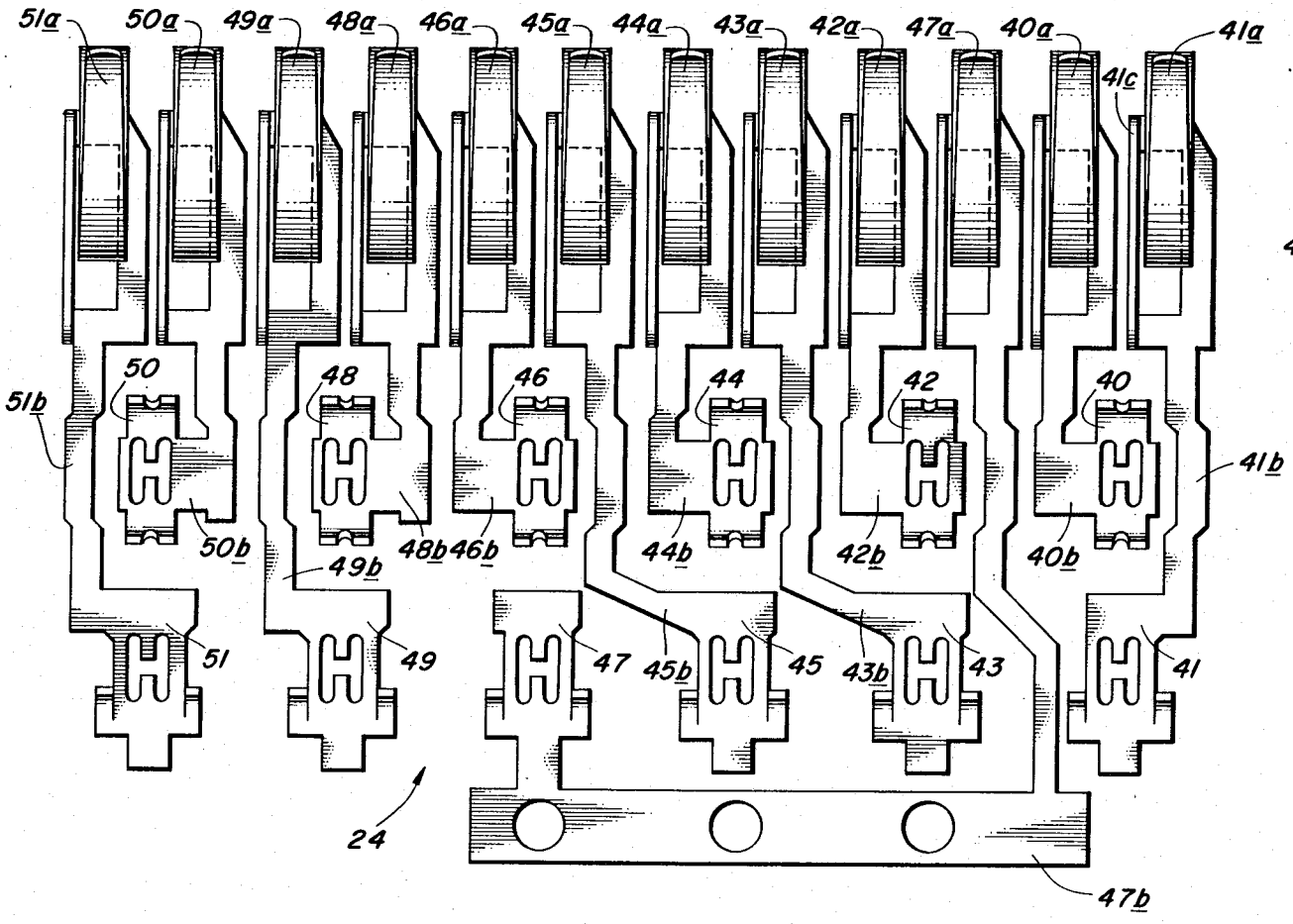
FIG. 3 is an enlarged plan view of a terminal array within the connector.

FIG. 4 shows a side elevation of ground terminal 41*a* with its associated side shield member 41*c*.

Figure 5:
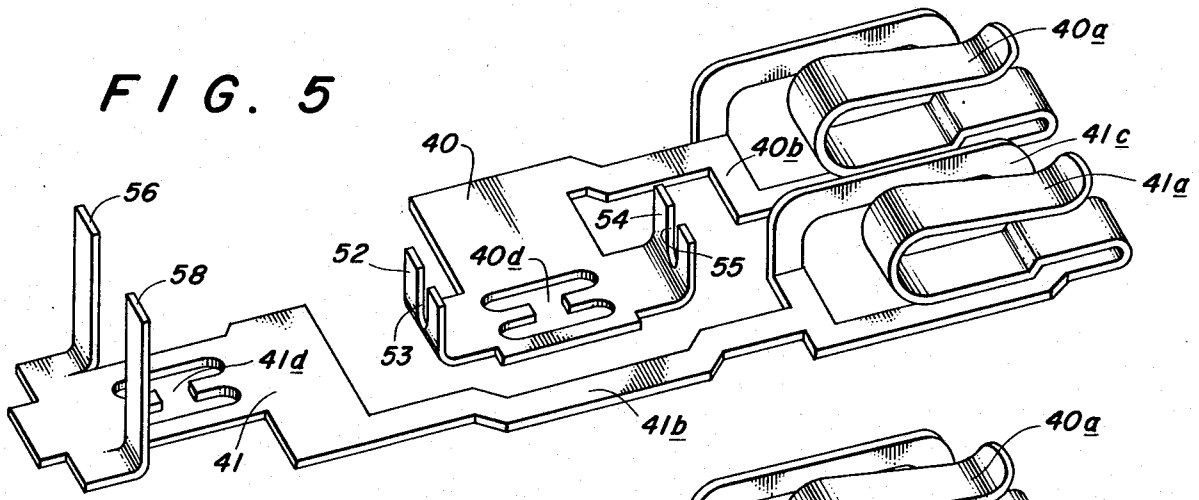
FIG. 5 is an enlarged fragmentary perspective view of the array illustrated in FIGS. 3 and 4.
Figure 6:
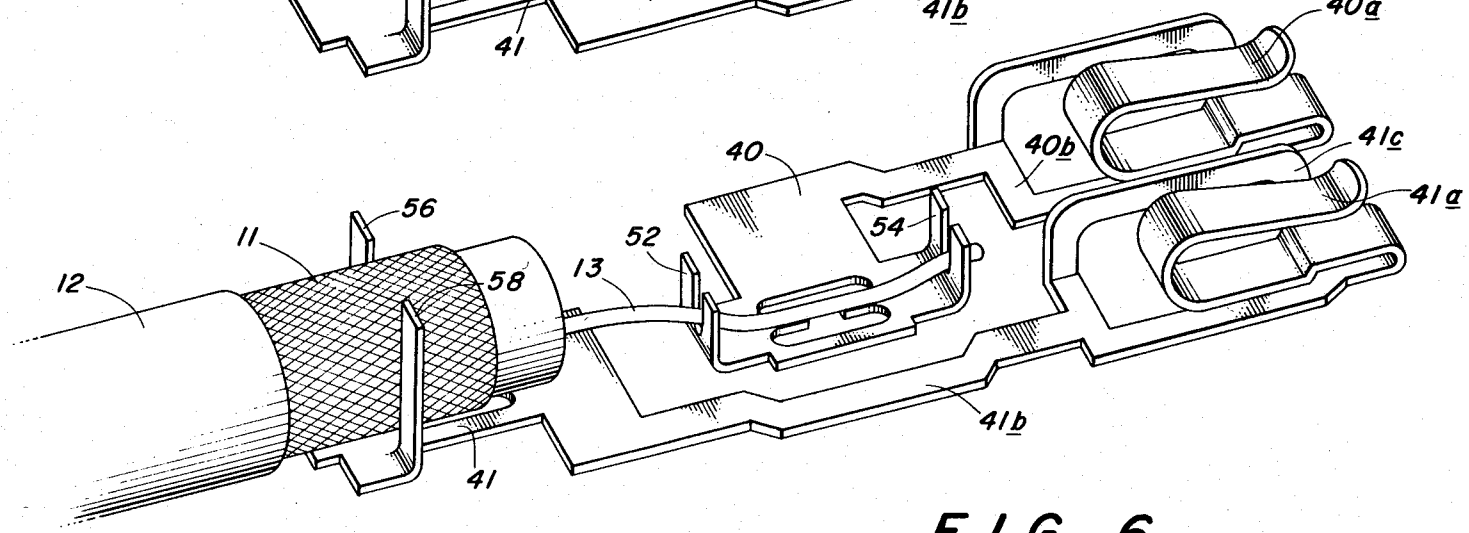
FIG. 6 is a view similar to FIG. 5 showing a coaxial conductor terminated therein.

As best shown in FIGS. 5 and 6, a ground terminal 41*a* and a signal terminal 40*a* are shown connected to a coaxial conductor 12. The signal tab 40 and the ground tab 41 are aligned with each other and have H shaped central openings 40*d* and 41*d* therethrough. The signal tab 40 is also seen to have upturned end portions 52, 54 with slots 53, 55 therein. The slots are about as wide as the diameter of signal wire 13 of conductor 12. The ground tab 41 has upturned side portions 56, 58 which are spaced from each other a distance about equivalent to the diameter of the ground shield 11 of conductor 12. The H-shaped opening of each tab is aligned with a window in the terminal block when located therein to permit accessibility to the tab for laser welding.

I claim:

1. A connector for connecting a plurality of coaxial cables arranged in a conductive pattern to another connector having terminals on spaced centers arranged in a different conductive pattern, each coaxial cable having a signal wire surrounded by a ground shield, said transition connector comprising: a terminal array arranged to match said spaced centers, each array including a plurality of elongated signal wire tabs having upturned end portions with slots therein said slots having a width approximating the diameter of the signal wire, said signal wire tab having a central opening therethrough and a plurality of elongated ground tabs of conductive material, each having a central opening therethrough and upturned side portions spaced from each other a distance approximating the diameter of the ground shield of the coaxial cable, said signal wire tabs and said ground wire tabs being arranged in pairs, each pair being axially aligned with each other and electrically isolated from each other; conductive paths connecting said ground and said signal tabs to said terminals according to the conductive pattern of the other connector to provide a desired programming of interconnection between said coaxial cables and said other connector; and a dielectric housing having multiple channels for receiving said coaxial cables, said signal tabs, said ground shield tabs and said conductive paths, said housing having openings therethrough aligned with said openings in said signal tabs and said ground shield tabs to permit access to said tabs for laser welding said tabs to respective ground shields and signal wires of said coaxial cables to form electrical connections therewith.

2. The transition connector of claim 1, said terminals being serpentine terminals.

3. The transition connector of claim 1, said central openings of said signal wire tabs and said ground shield tabs being H-shaped.

4. The transition connector of claim 1, said upturned end portions of the signal wire tabs contacting said signal wires and said upturned side portions of said ground tabs contacting said ground shield to form redundant electrical connections therewith.

* * * * *